US005238792A

United States Patent [19]

Prementine et al.

[11] Patent Number: 5,238,792

[45] Date of Patent: Aug. 24, 1993

[54] IMAGEABLE ARTICLES HAVING DYE SELECTIVE INTERLAYERS

[75] Inventors: Glenn S. Prementine, White Bear Lake; Takuzo Ishida, Woodbury, both of Minn.

[73] Assignee: Minnesota Mining and Manufacturing Company, Saint Paul, Minn.

[21] Appl. No.: 871,005

[22] Filed: Apr. 20, 1992

[51] Int. Cl.[5] ..... G03C 5/54

[52] U.S. Cl. ..... 430/201; 430/203; 430/214; 430/215

[58] Field of Search ..... 430/201, 203, 214, 215

[56] References Cited

U.S. PATENT DOCUMENTS

| | | | |
|---|---|---|---|
| 2,761,791 | 9/1956 | Russell | 117/34 |
| 3,330,663 | 7/1967 | Weyde et al. | 96/94 |
| 3,442,224 | 5/1969 | Rutkoski | 105/368 |
| 3,634,089 | 1/1972 | Hamb | 96/87 |
| 3,700,458 | 10/1972 | Lindholm | 96/114.1 |
| 3,785,830 | 1/1974 | Sullivan et al. | 96/114.1 |
| 4,021,240 | 5/1977 | Cerquone et al. | 96/29 |
| 4,021,250 | 5/1977 | Sashihara et al. | 96/114.1 |
| 4,022,617 | 5/1977 | McGuckin | 96/29 |
| 4,123,274 | 10/1978 | Knight et al. | 96/66 |
| 4,220,709 | 9/1980 | deMauriac | 430/353 |
| 4,368,247 | 1/1983 | Fletcher, Jr. et al. | 430/17 |
| 4,374,921 | 2/1983 | Frenchik | 430/338 |
| 4,452,883 | 6/1984 | Frenchik et al. | 430/502 |
| 4,460,681 | 7/1984 | Frenchik | 430/502 |
| 4,478,927 | 10/1984 | Naito et al. | 430/203 |
| 4,594,307 | 6/1986 | Ishida | 430/203 |
| 4,780,010 | 10/1988 | Behrens et al. | 400/208 |
| 4,883,747 | 11/1989 | Grieve et al. | 430/542 |
| 4,923,792 | 5/1990 | Grieve et al. | 430/559 |
| 5,077,178 | 12/1991 | Herbert et al. | 430/340 |

FOREIGN PATENT DOCUMENTS

| | | |
|---|---|---|
| 1243536 | 10/1988 | Canada . |
| 59-165054 | 9/1984 | Japan . |
| 59-168439 | 9/1984 | Japan . |
| 837095 | 11/1958 | United Kingdom . |

OTHER PUBLICATIONS

Copending U.S. Application Ser. No. 07/775,193, "Photothermographic Article For Preparing Multicolor Images", (Ishida et al.) filed Oct. 11, 1991.

M. Sekiya et al., *Chem. Pharm. Bulletin,* 1972, 20(2), 343; Ibid 1974, 22(2), 448.

T. Sohda et a., *Chem. Pharm. Bull.,* 1983, 31(2), 560–565.

"Polymer Handbook", 2nd Edition (edited by J. Brandrup and E. H. Immergut, published by John Wiley and Sons, Inc.

Copending U.S. Application Ser. No. 07/870,916, "Imageable Articles Having Dye Selective Interlayers" (Prementine et al.) filed Apr. 20, 1992.

Copending U.S., Application Ser. No. 07/895,045, "Imageable Articles Having Dye Selective Interlayers", (Prementine et al.) filed Jun. 8, 1992.

T. H. James in *The Theory of the Photographic Process,* Fourth Ed.; MacMillan, New York, 977; pp. 149–169, 374.

Research Disclosures No. 17029, Jun. 1978, pp 9–15.

The Colour Index; The Society of Dyes and Colourists; Yorkshire, England, 1971; vol. 4, p. 4437.

K. Venkataraman in *The Chemistry of Synthetic Dyes;* Academic Press; New York, 1952; vol. 2, p. 1206.

F. M. Hamer in *The Cyanine Dyes and Related Compounds;* Interscience Publishers: New York, 1964; p. 492.

F. X. Smith et al., *Tetrahedron Lett.,* 1983, 24(45), 4951–4954.

X. Huang and L. Xe, *Synthetic Communications, 1986, 16(13), 1701–1707.*

H. Zimmer et al., *Journal of Organic Chemistry,* 1960, 25, 1234–1235.

*Primary Examiner*—Richard L. Schilling

*Attorney, Agent, or Firm*—Gary L. Griswold; Walter N. Kirn; Gregory A. Evearitt

[57] ABSTRACT

Imageable articles having dye selective interlayers comprising copolymers of styrene and vinylidene chloride are disclosed. The interlayers have sufficient permeability to be useful for constructions in which cationic dyes must be prevented from diffusing away from an image receiving layer. Additionally, the selective interlayers allow unoxidized leuco dye to be diffused away from an image receiving layer, thereby increasing print stability. Use of these interlayers in multicolor dye-diffusive imaging constructions increases image stability and color density in the final image.

14 Claims, No Drawings

IMAGEABLE ARTICLES HAVING DYE SELECTIVE INTERLAYERS

FIELD OF THE INVENTION

This invention relates to imageable articles capable of producing multi-color images by dye diffusion. In particular, this invention relates to silver-based photothermographic materials employing oxidizable leuco dyes.

BACKGROUND OF THE ART

Imaging systems capable of producing multiple colors often rely upon barrier interlayers to separate adjacent imaging chemistries. In some cases, such as those in which a dye image is formed and diffused to a receiving layer, the interlayer must not only separate imaging chemistries, but must be permeable to dyes as well. Dry silver-based imageable articles are one type of imaging system that may employ interlayers in this manner.

Dry silver compositions are photothermographic compositions and contain a light-insensitive, reducible silver source; a light-sensitive silver source; and a reducing agent for the light-insensitive, reducible silver source. The light-sensitive material is generally photographic silver halide (e.g., silver chloride), which must be in catalytic proximity to the light-insensitive, reducible silver source (e.g., silver behenate). Catalytic proximity requires an intimate physical association of these two materials so that when silver specks or nuclei are generated by the irradiation or light exposure of the photographic silver halide, those nuclei are able to catalyze the reduction of the light-insensitive, reducible silver source by the reducing agent. It has been long understood that light exposed silver halide is a catalyst for the reduction of silver ions and the silver-generating, light-sensitive silver halide catalyst progenitor may be placed into catalytic proximity with the silver source in a number of different fashions, such as for example, by partial metathesis of the reducible silver source with a halogen-containing source and coprecipitation of silver halide and light-insensitive, reducible silver source material.

In both photographic and photothermographic emulsions, exposure of the photographic silver halide to light produces small clusters of silver atoms. The image-wise distribution of these clusters is known in the art as a latent image. As this latent image generally is not visible by ordinary means, the light-sensitive article must be further processed in order to produce a visual image. The visual image is produced by the catalytic reduction of silver ions which are in catalytic proximity to the silver halide grains bearing the latent image.

In color dry silver imaging systems, a leuco dye is typically incorporated as a reducing agent for the light-insensitive, reducible silver source, generally in combination with a spectral sensitizer for the silver halide. The leuco dye oxidizes to form a cationic dye upon development, thereby giving a colored image. In full color constructions, spectrally sensitized emulsion layers are typically coated onto a substrate and separated by one or more barrier interlayers.

Residual silver stain is a major problem with dry silver color constructions known in the art. This has been overcome by causing the developed dye image to diffuse from the dry silver layer to an image-receiving layer that is then stripped from the emulsion layer(s). In this case, a barrier interlayer must serve the dual roles of separating the chemistries of neighboring emulsion layers and allowing diffusion of the dye image under thermal processing conditions. In addition to the dye image, other components of the emulsion layers also diffuse to the image-receiving layer under thermal processing conditions. In this regard, unoxidized leuco dyes from the emulsion layers tend to diffuse to the image-receiving layer where they oxidize over time, leading to poor print stability and color separation. Therefore, there is a need for interlayers which allow dye images, but not unoxidized leuco dyes, to diffuse to the image-receiving layer.

Depending on the particular ingredients of a given dry silver layer, the development may be best carried out, for example, under acidic or basic conditions. When multiple dry silver layers with incompatible developing chemistries are employed, it is very difficult to keep development conditions within the dry silver layer from affecting the development of nearby or adjacent dry silver layers. As a result, it is advantageous to coat dry silver layers with different developing conditions on opposite sides of a transparent substrate.

U.S. Pat. No. 4,594,307 discloses a heat developable photographic material that produces a pure and stable dye image by the oxidation-reduction reaction between a reducible organic silver salt and a leuco dye reducing agent wherein the dye formed is transferred to an image-receiving layer by continuing the heating for development in order to separate the dye formed from the silver images and other residual chemicals.

The generation of color dry silver images has been accomplished using microencapsulated constructions and tri-pack (yellow/magenta/cyan) multilayer constructions such as those disclosed in U.S. Pat. Nos. 4,883,747 and 4,923,792. These patents disclose the use of polystyrene; partially hydrolyzed polyvinyl acetate; and polyvinyl butyral as barrier interlayers.

U.S. Pat. Nos. 4,021,240; 4,460,681; and 5,077,178 disclose the use of multiple image forming layers separated by barrier or interlayers.

SUMMARY OF THE INVENTION

In accordance with the present invention, it has been discovered that copolymers of styrene and vinylidene chloride are useful as interlayers in dye-diffusive imageable articles employing cationic dyes and neutral leuco dyes and have the ability to selectively hinder cationic dye diffusion while permitting neutral leuco dye diffusion. The copolymer based interlayers of the present invention may be employed in imageable articles in order to increase print stability and improve color density.

In one embodiment, the present invention provides imageable articles comprising: (a) an image-receiving layer; (b) adjacent to the image-receiving layer, an image-forming layer comprising a leuco dye which generates a cationic dye upon oxidization; and (c) adjacent to the image-forming layer, a polymeric interlayer comprising a styrene-vinylidene chloride copolymer.

In another embodiment, the present invention provides dye diffusive, dry silver photothermographic elements comprising a suitable substrate coated on one side thereof with an image-receiving layer, the image-receiving layer having coated thereon at least one image-forming layer polymeric interlayer, the polymeric interlayer comprising a styrene-vinylidene chloride copolymer and the image-forming layer comprising a neutrally charged leuco dye which when oxidized forms a cationic dye.

In still another embodiment, the present invention provides a method of purifying a mixture comprising a non-ionic leuco dye and a cationic dye, the method comprising heating the mixture comprising the non-ionic leuco and cationic dyes while in intimate contact with a layer comprising a styrene-vinylidene chloride copolymer, thereby causing the non-ionic leuco dye to diffuse through the layer and separate from the mixture.

By the phrase "intimate contact", it is meant that the mixture containing the cationic dye and non-ionic leuco dye must be in direct contact with the layer, typically an interlayer, comprising the styrene-vinylidene chloride copolymer. For example, the dye-containing mixture may be overcoated with the polymeric layer. In another possible arrangement, the dye-containing mixture is applied to one substrate and the polymeric layer is applied to another substrate and then the two structures are laminated together such that the dye-containing mixture and the polymeric layer are in direct contact with one another.

Other aspects, advantages, and benefits of the present invention are apparent from the detailed description, examples, and claims.

DETAILED DESCRIPTION OF THE INVENTION

The present invention provides imageable articles (having improved image stability) which comprise: (a) an image-receiving layer; (b) adjacent to the image-receiving layer, an image-forming layer comprising a leuco dye which generates a cationic dye upon oxidization; and (c) adjacent to the image-forming layer, a polymeric interlayer comprising a styrene-vinylidene chloride copolymer.

While single color applications are envisioned, the greatest benefit of the present invention may be obtained in multicolor or full color applications. These typically comprise a substrate having a dye-receiving layer coated thereon, the dye-receiving layer having coated thereon a plurality of imaging layers separated by polymeric interlayers. At least one of the interlayers comprises a copolymer of styrene and vinylidene chloride.

Alternatively, the image-receiving layer may be supplied as an external component carried on a second substrate that is laminated with a first substrate bearing an image-forming layer during processing such that the dye image is transferred from the first substrate to the image-receiving layer. In that case, the laminated construction constitutes an imaged construction according to the present invention.

Image-Forming Layer

The image forming layer may be of any type known in the imaging arts in which a colored dye image is formed by oxidation of a neutral leuco dye to form a cationic image.

In a preferred embodiment, the image-forming layer(s) comprises a dry silver composition which comprises an intimate mixture of a light-sensitive silver halide; a light-insensitive, reducible silver source, such as a silver salt of an organic acid (e.g., silver behenate, silver benzimidazolate, or silver saccharine); and an auxiliary reducing agent. As used herein, the phrase "auxiliary reducing agent" refers to an additional reducing agent (e.g., phenols, hindered phenols, methyl gallate, catechol, pyrogallol, hydroquinone, etc.) for the light insensitive, reducible source of silver in addition to the leuco dye which also functions as a reducing agent for silver ion. Normally, dry silver compositions further comprise a spectral sensitizer. Such a mixture is usually prepared in a solvent as a dispersion that is spread as a layer on a suitable substrate. When dry, the layer is exposed to a light image and thereafter, a reproduction of the image is developed by heating the coated substrate.

Imaging layer(s) of the invention may comprise a single coated layer or a plurality of sequentially coated sublayers in which the various components are dispersed. In cases where the imaging layers comprise a plurality of sublayers, the sublayer containing the silver halide is referred to as an emulsion layer.

Silver Halide

Photographic silver halides useful in the present invention include, but are not limited to, silver chloride, silver chlorobromide, silver chloroiodide, silver bromide, silver iodobromide, silver chloroiodobromide, and silver iodide.

The silver halide used in the present invention may be used as is. However, it may be chemically sensitized with a chemical sensitizing agent such as compounds of sulfur, selenium, or tellurium, etc.; compounds of gold, platinum, palladium, rhodium or iridium, etc.; a reducing agent such as tin halide; or combinations thereof. Details thereof described in James, T. H. *The Theory of the Photographic Process*, Fourth Ed.; MacMillan: New York, 1977; pp. 149-169.

The light sensitive silver halide used in the present invention is preferably employed in a range of 0.01 to 10.0 percent by weight, and more preferably 0.1-1.0 percent by weight, based upon the total weight of each imaging layer in which the silver halide is present.

Sensitizer

The sensitizer, if employed, may be any dye known in the photographic arts to spectrally sensitize silver halides. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

An appropriate amount of a sensitizing dye added is generally in the range of from $10^{-10}$ to $10^{-1}$ mole, and preferably from $10^{-8}$ to $10^{-3}$ mole per mole of silver halide.

Light-Insensitive, Reducible Organic Silver Salt

The light-insensitive, reducible organic silver salt that can be used in the present invention is a silver salt that is comparatively stable to light and which forms a silver image by reacting with the above described leuco compound, or an auxiliary developing agent that is coexisting with the leuco compound, if desired, when it is heated to a temperature of above 80° C. and preferably, above 100° C., in the presence of exposed silver halide. Suitable organic silver salts include silver salts of organic compounds having a carboxyl group. Preferred examples thereof include silver salts of aliphatic and aromatic carboxylic acids. Preferred examples of silver salts of aliphatic carboxylic acids include silver behenate, silver stearate, silver oleate, silver laureate, silver caproate, silver myristate, silver palmitate, silver maleate, silver fumarate, silver tartarate, silver furoate, silver linoleate, silver butyrate, silver 4 g camphorate, and mixtures thereof. Silver salts that are substituted with a halogen atom or a hydroxyl group can also be effectively used. Preferred examples of silver salts of aromatic carboxylic acids and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, silver gallate, silver tannate, silver phthalate, silver terephthalate, silver salicylate, silver phenylacetate, silver pyromellitate, silver salts of 3-carboxymethyl-4-methyl-4-thiazoline-2-thiones or the like as disclosed in U.S. Pat. No. 3,785,830; and silver salts of aliphatic carboxylic acids containing a thioether group as disclosed in U.S. Pat. No. 3,330,663. Silver salts of compounds containing mercapto or thione groups and derivatives thereof can also be used. Preferred examples of these compounds include silver 3-mercapto-4-phenyl-1,2,4-triazolate, silver 2-mercaptobenzimidazolate, silver 2-mercapto-5-aminothiadiazolate, silver 2-(S-ethylglycolamido)benzothiazolate; silver salts of thioglycolic acids such as silver salts of S-alkyl thioglycolic acids (wherein the alkyl group has from 12 to 22 carbon atoms); silver salts of dithiocarboxylic acids such as silver dithioacetate, silver thioamidoate, silver 1-methyl-2-phenyl-4-thiopyridine-5-carboxylate, silver triazinethiolate, silver 2-sulfidobenzoxazole, and other silver salts as disclosed in U.S. Pat. No. 4,123,274. Furthermore, silver salts of a compound containing an amino group can be used. Preferred examples of these compounds include silver salts of benzotriazoles, such as silver benzotriazolate; silver salts of alkyl substituted benzotriazoles such as silver methylbenzotriazolate, etc.; silver salts of a halogen substituted benzotriazoles such as silver 5-chlorobenzotriazolate, etc.; silver salts of carboimidobenzotriazoles, etc.; silver salts of 1,2,4-triazoles and 1-H-tetrazoles as described in U.S. Pat. No. 4,220,709; silver salts of imidazoles; and the like.

The silver halide and the organic silver salt that form a starting point of development should be in reactive association (i.e., in the same layer, in adjacent layers, or in layers separated from each other by an intermediate layer having a thickness of less than 1 micron). It is preferred that the silver halide and the organic silver salt are present in the same layer.

The silver halide and the organic silver salt that are separately formed in a binder can be mixed before use to prepare a coating solution, but it is also effective to blend both of them in a ball mill for a long time. Further, it is effective to use a process which comprises adding a halogen-containing compound in the organic silver salt to partially convert the silver of the organic silver salt to silver halide. Methods of preparing these silver halide and organic silver salts and their blending are disclosed in *Research Disclosures* No. 17029 and U.S. Pat. No. 3,700,458.

The light-insensitive, reducible source of silver is preferably present in an amount of from 0.1–50 weight percent, and more preferably 1–5 weight percent, based upon the total weight of each imaging layer(s) in which the silver source is present.

A suitable coating amount of the light-sensitive silver halide and the light-insensitive, reducible organic silver salt employed in the present invention is in a total from 50 mg to 10 g/m$^2$, calculated as an amount of silver, for example, as disclosed in U.S. Pat. No. 4,478,927.

Leuco Dye

Suitable leuco dyes for use in the present invention are compounds that oxidize to form a dye image. In the practice of the present invention, at least one image-forming layer must comprise leuco dye which is oxidizable to a cationic dye, although leuco dyes used in additional image-forming layers, if present, may form neutral, anionic, or cationic dyes on oxidation. Leuco dyes that form oxazine (e.g., Basic Blue 3), thiazine, or diazine dyes are preferred.

Useful neutral leuco dyes that form neutral dyes are phenolic leuco dyes such as 2-(3,5-di-t-butyl-4-hydroxyphenyl)-4,5-3-diphenylimidazole or bis(3,5-di-t-butyl-4-hydroxyphenyl)phenylmethane. Examples of leuco dyes useful in the practice of the present invention are disclosed in U.S. Pat. Nos. 4,374,921; 4,460,681; 4,594,307; and 4,780,010.

The leuco dyes used in the present invention may be any colorless or lightly colored compound that forms a visible dye upon oxidation. The compound must be oxidizable to a colored state. Compounds that are both pH sensitive and oxidizable to a colored state are useful, while compounds sensitive only to changes in pH are not included within the term "leuco dyes" since they are not oxidizable to a colored form. The dyes formed from the leuco dye in the various color-forming layers should, of course be different. A difference of at least 60 nm in reflective maximum absorbance is preferred. More preferably, the absorbance maximum of dyes formed will differ by at least 80–100 nm. When three dyes are to be formed, two should differ by at least these minimums and the third should preferably differ from at least one of the other dyes by at least 150 and more preferably, by at least 200 or higher nm. Any leuco dye capable of being oxidized by silver ion to form a visible dye is useful in the present invention as previously noted. Leuco dyes such as those disclosed in U.S. Pat. Nos. 3,442,224; 4,021,250; 4,022,617; and 4,368,247 are also useful in the present invention.

Other leuco dyes which may be used in imaging layers as well include, for example, benzylidene leuco compounds as disclosed in U.S. Pat. No. 4,923,792. The reduced form of the dyes must absorb less strongly in the visible region of the electromagnetic spectrum and must be oxidized by silver ions back to the original colored form of the dye. Benzylidene dyes have extremely sharp spectral characteristics giving high color purity of low gray level. The dyes have large extinction coefficients, typically on the order of $10^4$ to $10^5$, and possess good compatibility and heat stability. The dyes are readily synthesized and the reduced leuco forms of the compounds are very stable.

The dyes generated by the leuco compounds employed in the present invention are known and are disclosed, for example, in *The Colour Index*; The Society of Dyes and Colourists: Yorkshire, England, 1971; Vol. 4, p. 4437; and Venkataraman, K. *The Chemistry of Synthetic Dyes*; Academic Press: New York, 1952; Vol. 2, p. 1206; U.S. Pat. No. 4,478,927; and Hamer, F. M. *The Cyanine Dyes and Related Compounds*; Interscience Publishers: New York, 1964; p. 492.

The leuco compounds may readily be synthesized by techniques known to those skilled in the art of synthetic organic chemistry. There are many known methods of synthesis from precursors since the reaction is a simple two-step hydrogen reduction. Suitable methods are disclosed, for example, in: F. X. Smith et al. *Tetrahedron Lett.* 1983, 24(45), 4951–4954; X. Huang. L. Xe, *Synth. Commun.* 1986, 16(13) 1701–1707; H. Zimmer et al. *J. Org. Chem.* 1960, 25, 1234–5; M. Sekiya et al. *Chem. Pharm. Bull.* 1972, 20(2), 343; Ibid 1974, 22(2), 448; and T. Sohda et al. *Chem. Pharm. Bull.* 1983, 31(2) 560–5.

Other image forming materials, where the mobility of the compound having a dye part changes as a result of an oxidation-reduction reaction with silver halide or with an organic silver salt at an elevated high temperature, can be used as disclosed in published Japanese Patent Application No. 165,054 (1984). Many of the above described materials are materials wherein an image-wise distribution of mobile dyes corresponding to exposure is formed in the light-sensitive material by heat development. Processes obtaining visible images by transferring the dyes of the image to a dye fixing material (diffusion transfer) have been described in published Japanese Patent Application Nos. 168,439 (1984) and 182,447 (1984).

The total amount of leuco dye utilized in the present invention should preferably be in the range of 1–50 weight percent, and more preferably in the range of 5–20 weight percent, based upon the total weight of each individual imaging layer in which the leuco dye(s) is (are) employed.

When the heat developable, light-sensitive material used in this invention is heat developed in a substantially water-free condition after or simultaneously with image-wise exposure, a mobile dye image is obtained simultaneously with the formation of a silver image, either in exposed areas or in unexposed areas with exposed light-sensitive silver halide.

The light-sensitive silver halide and the organic silver salt oxidizing agent used in the present invention are generally added to at least one binder as disclosed below. Furthermore, the dye releasing redox compound is dispersed in the binder(s) disclosed below.

The binder(s) that can be used in the present invention can be employed individually or in combination with one another. The binder may be hydrophilic or hydrophobic. A typical hydrophilic binder is a transparent or translucent hydrophilic colloid, examples of which include a natural substance, for example, a protein such as gelatin, a gelatin derivative, a cellulose derivative, etc., a polysaccharide such as starch, gum arabic, pullulan, dextrin, etc., and a synthetic polymer, for example, a water-soluble polyvinyl compound such as polyvinyl alcohol, poly(vinylpyrrolidone), acrylamide polymer, etc. Another example of a hydrophilic binder is a dispersed vinyl compound in latex form which is used for the purpose of increasing dimensional stability of a photographic material.

Preferably, the polymeric binder is present in amount in the range from 1–99 weight percent, and more preferably from 20–80 weight percent of each imaging layer in which the polymeric binder is employed.

The coating amount of the binder used in the present invention is preferably 20 g or less per $m^2$; more preferably, 10 g or less per $m^2$; and most preferably, 7 g or less per $m^2$.

The preferred photothermographic silver containing polymer is poly(vinyl butyral), but ethyl cellulose, methacrylate copolymers, maleic anhydride ester copolymers, polystyrene, and butadiene-styrene copolymers can be used where applicable according to the solvents used.

In the photographic light-sensitive material and the dye fixing material of the present invention, the photographic emulsion layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; and mucohalogenic acids such as mucochloric acid, mucophenoxychloric acid, etc.; and combinations thereof.

Image-Receiving Layer

Dyes generated during thermal development of light-exposed regions of the emulsion layers migrate under development conditions into a dye receiving layer wherein they are retained. The dye receiving layer may be composed of a polymeric material having affinity for the dyes employed which will vary depending on the ionic or neutral characteristics of the dyes.

Examples of organic polymeric materials used in the dye receiving material of this invention include polystyrene having a molecular weight of 2,000 to 85,000, polystyrene derivatives having substituents with not more than 4 carbon atoms, poly(vinylcyclohexene), poly(divinylbenzene), poly(vinylpyrrolidine), poly(N-vinylcarbazole), poly(allylbenzene), polyvinyl alcohol, polyacetals such as polyvinyl formal and poly(vinylbutyral), polyvinyl chloride, chlorinated polyethylene, polytrifluoroethylene, polyacrylonitrile, poly(N,N-dimethylallylamide), polyacrylates having a p-cyanophenyl group, a pentachlorophenyl group or a 2,4-dichlorophenyl group, poly(acryl chloroacrylate), poly(methyl methacrylate), poly(ethyl methacrylate), poly(propyl methacrylate), poly(isopropyl methacrylate), poly(isobutyl methacrylate), poly(tert-butyl methacrylate), poly(cyclohexyl methacrylate), polyethylene glycol dimethacrylate, poly(cyanoethyl methacrylate), polyesters such as polyethylene terephthalate, polysulfone bisphenol A polycarbonate, polycarbonates, polyanhydrides, polyamides, and cellulose acetate. The synthetic polymers described in "Polymer Handbook", 2nd edition (edited by J. Brandrup and E. H. Immergut, published by John Wiley and Sons, Inc.) are also useful. These polymeric substances may be used singly or a plurality of them may be used in the form of a copolymer.

Interlayers

Interlayers employed in the present invention are selected from polymeric materials that are selectively permeable to dyes used to form the developed image. They are preferably coated from solvents in which the previously coated emulsion layer is not soluble. At least one of the interlayers employed in the present invention must be a styrene-vinylidene chloride copolymer. The polymer may be either block or random. The mole ratio of styrene to vinylidene chloride should preferably be from about 0.3 to 0.95:1; more preferably from 0.4 to 0.9; and most preferably from 0.5 to 0.8:1.

Interlayers of the present invention provide a means for improving image density of cationic dyes. This is accomplished by placing imaging layer(s) containing leuco dyes that oxidize to form cationic dyes closer to the dye receiving layer than any interlayer comprising a styrene-vinylidene chloride copolymer. In this arrangement, the cationic dyes may not diffuse to higher imaging layers, thereby increasing the image density in the dye receiving layer. In a preferred embodiment of the present invention, the first coated interlayer comprises a styrene-vinylidene chloride copolymer and the first coated imaging layer (i.e. the imaging layer is coated onto the dye receiving layer) contains a leuco dye that forms a cationic dye on exposure and thermal development.

Such dye selective permeable polymers can be used as interlayers in construction of an at least two, and preferably at least three, color photothermographic color recording system. This type of construction with the proper-solvent selection is conducive to the use of simultaneous multiple coating techniques with good color separation and enables the simulataneous thermal development of at least two or at least three individual color forming photothermographic systems having different chemistries, but similar thermal properties.

Preferably, the interlayers employed in the imageable articles of the present invention should be impermeable to the solvent employed in any layers subsequently coated onto it. The test for determining if an interlayer polymer is impermeable to the solvent of the next layer can be simply performed. First, a layer containing a sensitized, halidized silver salt of a fatty carboxylic (for example, 10–30 carbon atoms and preferably 12–28 carbon atoms) acid and polyvinyl butyral polymer is coated onto a suitable substrate. A second coating comprising interlayer polymer is applied after the first coating has dried. The last layer contains the appropriate solvent, a color forming developer, and toner reactant. The dried coatings are given an excessive light exposure and then heated for 60 seconds at 120°–130° C. The test is positive if no color or image is formed.

The imageable elements of the present invention may be optionally overcoated with a protective coating. Suitable materials for the protective coating include, but are not limited to, polymers that are insoluble in aqueous systems, soluble in some organic solvents, and impervious to certain other organic solvents. The "barrier" polymer, which is the fourth layer and preferably contains the color reactants, is normally a methyl methacrylate polymer (preferably a hard polymer with a Tukon hardness of 20 or more), copolymer, or blend with other polymers or copolymers (for example, copolymers with n-butyl acrylate, butyl methacrylate, and other acrylics such as acrylic acid, methacrylic acid, acrylic anhydride, and the like), polystyrene, or a combination of a polyvinyl chloride tripolymer with a butadiene-styrene copolymer. A preferred polymer is a hard methyl methacrylate homopolymer (i.e., having a Tukon hardness greater than 20, for example Acryloid A21 TM with a Tukon hardness of 21–22) blended with soft methyl methacrylate copolymers (i.e., having a Tukon hardness of less than 20, for example Acryloid B-66 TM with a Tukon hardness of less than 18). The barrier layer may also be crosslinked. This would be preferably done by the inclusion of a latent or activatable crosslinking agent. Crosslinking could then be effected after coating.

The theory of this process is essentially the same for a light-sensitive material comprising a negative emulsion and a light-sensitive material comprising a direct positive emulsion and differs only in that the portion to be developed is an exposed area in one and an unexposed area in the other. Accordingly, even when a direct positive emulsion is used, a dye image providing good color reproducibility is obtained in the same way as in the case of a negative emulsion.

Hearing in a substantially water-free condition, as used herein, means heating at a temperature of 80° to 250° C. The term "substantially water-free condition" means that the reaction system is in equilibrium with water in the air and water for inducing or promoting the reaction is not particularly or positively supplied from exterior to the element. Such a condition is described at page 374 of "The Theory of the Photographic Process", 4th Edition (T. H. James, published by MacMillan Co.).

The coating solution used in this invention may be prepared by separately forming a silver halide and an organic silver salt oxidizing agent and mixing them before use. It is also effective to mix the two in a ball mill for a long period of time. Another effective method comprises adding a halogen-containing compound to the prepared organic silver salt oxidizing agent and forming silver halide by the reaction of the halogen-containing compound with silver in the organic silver salt oxidizing agent.

The various layers comprising the imageable articles of the present invention may contain surface active agents for various purposes; e.g., as coating aids or for prevention of electrical charging, improvement of lubricating properties, emulsification, prevention of adhesion, improvement of photographic properties (for example, acceleration of development providing hard tones or sensitization), etc. For example, it is possible to use nonionic surface active agents such as saponin (steroid), alkylene oxide derivatives (for example, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxyl group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkyl phenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkyl betaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic, or heterocyclic phosphonium salts, aliphatic, or heterocyclic sulfonium salts, etc.

Of the above-described surface active agents, polyethylene glycol-type nonionic surface active agents having a repeating unit of ethylene oxide in their molecules are often preferably incorporated into the light-sensitive material. It is particularly preferred that the molecule contains five or more of the recurring units of ethylene oxide.

The light-sensitive material used in the present invention may contain, if desired or necessary, various additives known for heat developable light-sensitive materials and may have a layer or layers other than the light-sensitive layer, for example, an antistatic layer, an electrically conductive layer, a protective layer, an intermediate layer, an antihalation layer, a strippable layer, etc.

The imageable articles of the present invention are coated on a suitable substrate. Suitable substrates include rigid and flexible substrates; metals (for example, steel and aluminum plates, sheets, and foils); films or plates composed of various film-forming synthetic or high polymers including addition polymers (for example, polyvinylidene chloride, polyvinyl chloride, polyvinyl acetate, polystyrene, polyisobutylene polymers, and copolymers thereof), and linear condensation polymers (for example, polyethylene terephthalate, polyhexamethylene adipate, and polyhexamethylene adipamide/adipate); nonwoven wood byproduct based substrates such as paper and cardboard; and glass. Substrates may be transparent, translucent, or opaque.

Especially useful substrates are films of cellulose acetate films such as cellulose triacetate or diacetate, films of polyamides derived from a combination of heptamethylenediamine and terephthalic acid, a combination of fluorenedipropylamine and adipic acid, a combination of hexamethylenediamine and diphenic acid, and a combination of hexamethylenediamine and isophthalic acid, films of polyesters derived from a combination of diethylene glycol and diphenylcarboxylic acid and a combination of bis-p-carboxyphenoxybutane and ethylene glycol, a polyethylene terephthalate film, and a polycarbonate film.

The films may be modified; for example, polyethylene terephthalate films may be modified by such modifiers as cyclohexane dimethanol, isophthalic acid, methoxypolyethylene glycol, or 1,2-dicarbomethoxybenzenesulfonic acid.

The substrate used for the light-sensitive material in the present invention is one that has good dimensional stability at the processing temperature. Preferably, the polyesters disclosed in U.S. Pat. No. 3,634,089 are used. More preferably, a polyethylene terephthalate film is used.

If necessary, two or more layers may be applied at the same time such as by the methods disclosed in U.S. Pat. No. 2,761,791 and British Patent No. 837,095.

In the present invention, the latent image obtained after exposure of the light-sensitive material can be developed by heating the material at a moderately elevated temperature of, for example, about 80° to about 250° C., for about 0.5 second to about 300 seconds. By increasing or decreasing the heating time, the temperature may be higher or lower within the above range. Temperatures in the range of about 110° to about 160° C. are especially useful. Heating may be carried out by the usual heating means such as a hot plate, an iron, a hot roller, a heat generator using carbon or titanium white, or the like.

The imageable articles of the present invention are prepared by coating methods generally known in the art and disclosed in U.S. Pat. Nos. 2,761,791 and 4,452,883, and British Patent No. 837,095.

Heating for transfer of the dyes can be effected by using the same heating means as exemplified for the heat development. To increase the quality of the dye image transferred to the dye receiving layer, it is preferred to prevent an increase in fogging by the occurrence of unnecessary development during dye transfer. For this purpose, it is especially effective to include a compound that reacts with the silver halide and/or can have the silver halide adsorbed thereon as a development stopping agent and/or an antifoggant in any one of the layers constituting the dye receiving material. Such a compound is preferably included in the dye receiving layer or a layer provided above the dye receiving layer, such as a protective layer, because it rapidly inhibits excessive development of the light-sensitive layer during transfer of the dye by heating and a sharp and clear dye image can be obtained. Such compounds include, for example, a nitrogen-containing heterocyclic compound, preferably a 5- or 6-membered heterocyclic compound containing a nitrogen atom.

The following non-limiting examples further illustrate the present invention.

EXAMPLES

The materials used in the examples herein are commercially available, such as from Aldrich Chemical Co. (Milwaukee, Wis.), unless otherwise specified.

The dyes referred to in the following examples have the following structural formulae:

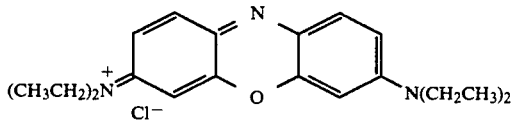

Basic Blue 3

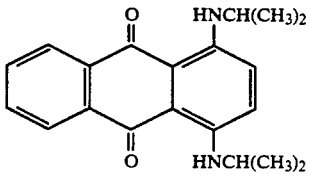

Oil Blue A

-continued

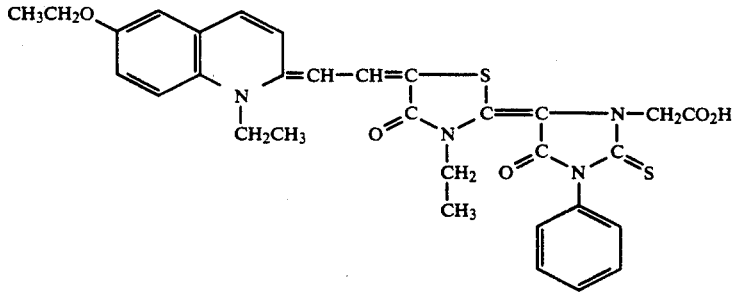

Red Sensitizing Dye A

EXAMPLE 1

This example describes preparation of some styrene-vinylidene chloride copolymers used in the present invention. The monomers were distilled from calcium hydride under nitrogen before polymerization. A solution of 70.1 ml vinylidene chloride, 10 ml styrene, and 100 mg azobis(isobutyronitrile) was heated to reflux for two days. The resultant solution was precipitated by dropwise addition to methanol. The precipitated polymer was filtered, redissolved in tetrahydrofuran, and reprecipitated by addition to methanol. Following filtration, the purified copolymer was dried in vacuo. The resultant polymer had the following composition: 32 mol% styrene; 68 mol% vinylidene chloride. The conversion of monomers was typically less than 5% by this method.

EXAMPLE 2

Diffusion of dyes through copolymer films of the present invention was measured as follows: The copolymers were coated from a 10 wt% solution as a 1 mil thick layer on a transparent substrate (type OR477400 primed polyester film, 0.1 mm thickness, 3M Company, St. Paul, MN) and oven dried at 80° C. A second layer consisting of 10 wt% polyvinyl butyral and 1 wt% dye in Fischer brand solvent alcohol (Fischer Scientific Co., Philadelphia, PA) was coated onto the first layer. If the $T_g$ of the second polymer was greater than 80° C., the sample was dried in an oven at 80° C., otherwise the coatings were air dried. The coating was then heated to 140° C. for 30 seconds. Absorbance measurements were made and the top layer was removed by repeated application and removal of Scotch brand Magic TM transparent tape (3M Company, St. Paul, MN). The percent dye diffusion was calculated as:

$$\%\ \text{dye transfer} = A_{(bottom\ layer)}/A_{(both\ layers)} \times 100\%.$$

Dyes used for evaluation of polymer diffusivity were Oil Blue A (a non-ionic anthraquinone dye, Du Pont Company, Wilmington, DE) and Basic Blue 3 (a cationic oxazine dye). The results for several copolymers are presented in Table 1.

TABLE 1

| Copolymer (mol % styrene/ mol % vinylidene chloride) | $T_g$ (°C.) | % Dye Transfer | |
|---|---|---|---|
| | | Oil Blue A | Basic Blue 3 |
| 32/68 | 57 | 70 | 9 |
| 41/59 | 64 | 68 | 3 |
| 53/47 | 81 | 57 | 0 |
| 68/32 | 89 | 40 | 0 |

TABLE 1-continued

| Copolymer (mol % styrene/ mol % vinylidene chloride) | $T_g$ (°C.) | % Dye Transfer | |
|---|---|---|---|
| | | Oil Blue A | Basic Blue 3 |
| 75/25 | 95 | 31 | 0 |

EXAMPLE 3

A 15% solution of a copolymer of vinyl chloride and vinyl acetate (9:1) in methyl ethyl ketone was coated at a wet thickness of 0.08 mm onto an opaque polyester film substrate and dried in an oven at a temperature of 80° C. for five minutes to form an image-receiving layer. A dispersion of silver behenate half soap (1 mol silver behenate to 1 mol behenic acid, 10% solids) in toluene was made by a homogenization process. A 110 g portion of the 10% half soap dispersion was diluted with 380 g ethanol. Then 0.4 g polyvinyl butyral was added to the dilute dispersion and dissolved. Mercuric bromide (10 ml of a solution containing 1.8 g mercuric bromide in 100 ml methanol) was added to the dispersion with stirring. Additional polyvinyl butyral (26 g) having a polyvinyl alcohol content in the range of 9-13% was added to the dispersion, hereinafter referred to as Dispersion A.

3M Fluorad TM FC-431 (3 drops, a fluorochemical coating additive employed as a stripping agent, 3M Company, St. Paul, MN) was added to a 25 g aliquot of Dispersion A and mixed. The resultant dispersion was coated onto the image-receiving layer at a wet thickness of 0.08 mm and dried in an oven at a temperature of 80° C. for 5 min to form a strippable blank emulsion layer.

The following polymer solutions were coated over the blank emulsion layer at a wet thickness of 0.08 mm and dried in an air oven at a temperature of 80° C. for 5 min to form an interlayer:

Comparative Example A: an interlayer coating solution was prepared by dissolving 3.5% of a copolymer of vinylidene chloride and vinyl chloride (1:20, obtained from Scientific Polymer Products, Inc., Ontario, NY) in tetrahydrofuran.

Comparative Example B: an interlayer coating solution was prepared by dissolving 3.5% of polystyrene (Styron 685D TM, Dow Chemical, Midland, MI) in toluene.

Example 3: an interlayer coating solution was prepared by dissolving 3.5% of a copolymer of styrene and vinyl chloride (1:1) in toluene.

Cyan leuco dye (0.3 g, 3,6-bis(diethylamino)-9-(4-methylbenzoyl)phenoxazine (obtained from Hodogaya Chemical Co., Ltd. (Tokyo, Japan) as L-704) was dissolved in 3 ml toluene. The solution was mixed with 1 ml of a solution containing 0.005 g of a red sensitizing dye A in 150 ml toluene and 50 ml methanol, 0.1 g 4-methylphthalic acid, and a 25 g aliquot of Dispersion A. The resulting mixed dispersion was coated onto the interlayer at a wet thickness of 0.13 mm and dried in an oven at a temperature of 80° C. for 5 min to form a cyan emulsion layer.

Strips were then cut from the resultant coated sheets and exposed to light in an EG&G sensitometer through a Wratten 25 red filter for $10^{-3}$ sec to produce heat-developable latent images in the emulsion layer. The exposed sheets were heat-developed at a temperature of 138° C. on a heat blanket for 30 sec. The portion of the element containing the photothermographic emulsion layers and the interlayer was then stripped away from the image-receiving layer. Cyan dye images corresponding to the red light exposed area of the sheets were observed to have been transferred to the image-receiving layer.

Additionally, N-bromosuccinimide solution (0.8 g in 50 ml acetone and 50 ml toluene) was dropped (approximately 0.015 ml) on the non-exposed area of the image receiving layer. The leuco dye which had been transferred to the image receiving layer through the emulsion layers and the interlayer was oxidized by the N-bromosuccinimide solution and formed cyan dye.

The treated area was dried at room temperature for 30 min. The optical density of the oxidized dye by the oxidizing agent was measured by the densitometer using a red filter to determine the diffusion of the leuco dye. The results are given in Table 2.

TABLE 2

| Sample | Optical Density of Exposed Area (corresponds to diffusion of oxidized dye) | Optical Density of Non-exposed area (corresponds to diffusion of leuco dye) |
|---|---|---|
| Comparative Example A | 2.27 | 1.52 |
| Comparative Example B | 0.16 | 1.04 |
| Example 3 | 1.02 | 1.60 |

The results in the preceding table show that the copolymer of Example 3 decreases the diffusion of cationic dye while permitting the diffusion of the leuco form of the dye relative to Comparative Example A. Comparative Example B has the greatest selectivity in the series, but does not have enough permeability to oxidized dyes to allow additional oxidized dyes to diffuse through from additional emulsion layers, not used in the example, but necessary for a full color construction.

Reasonable variations and modifications are possible from the foregoing disclosure without departing from either the spirit or scope of the present invention as defined by the claims.

What is claimed is:

1. An imageable article comprising: (a) an image-forming layer; (b) adjacent to said image-receiving layer, an image-forming layer comprising a light-insensitive, reducible silver source; a light-sensitive silver halide; a polymeric binder; a sensitizer, and a leuco dye which generates a cationic dye upon oxidization; and (c) adjacent to said image-forming layer, a polymeric interlayer comprising a styrene-vinylidene chloride copolymer.

2. The imaging article according to claim 1 wherein said light-insensitive, reducible silver source comprises a silver salt of an aliphatic carboxylic acid.

3. The imaging article according to claim 2 wherein said light-insensitive, reducible silver source comprises silver behenate.

4. The imaging article according to claim 1 wherein said light-sensitive silver halide comprises silver chloride.

5. The imaging article according to claim 1 wherein said imaging layer further comprises toner.

6. The imaging article according to claim 1 wherein the mole ratio of styrene to vinylidene chloride in said interlayer is from about 0.3 to 0.95.

7. The imaging article according to claim 6 wherein the mole ratio of styrene to vinylidene chloride in said interlayer is from about 0.5 to 0.8.

8. A dry silver photothermographic element comprising a substrate coated on one side thereof with an image-receiving layer, said image-receiving layer having coated thereon at least one image-forming layer which is adjacent to a polymeric interlayer, said polymeric interlayer comprising a styrene-vinylidene chloride copolymer and said image-forming layer comprising a light-insensitive, reducible silver source; a light-sensitive silver halide; a polymeric binder; a sensitizer; and a leuco dye which generates a cationic dye upon oxidation.

9. The dry silver photothermographic element according to claim 8 wherein said light-insensitive, reducible silver source comprises a silver salt of an aliphatic carboxylic acid.

10. The dry silver photothermographic element according to claim 9 wherein said light-insensitive, reducible silver source comprises silver behenate.

11. The dry silver photothermographic element according to claim 8 wherein said light-sensitive silver halide comprises silver chloride.

12. The dry silver photothermographic element according to claim 8 wherein said imaging layer further comprises toner.

13. The dry silver photothermographic element according to claim 8 wherein the mole ratio of styrene to vinylidene chloride in said interlayer is from about 0.3 to 0.95.

14. The dry silver photothermographic element according to claim 13 wherein the mole ratio of styrene to vinylidene chloride in said interlayer is from about 0.5 to 0.8.

* * * * *